US007264767B2

(12) United States Patent
Schliefer et al.

(10) Patent No.: US 7,264,767 B2
(45) Date of Patent: Sep. 4, 2007

(54) METHOD AND DEVICE FOR REDUCING THE OXYGEN CONTENT OF A COPPER MELT

(75) Inventors: Heinrich Schliefer, Stevetsl (DE); Alexander Khoury, Vierhoefen (DE); Stefan Schneider, Ashausen (DE)

(73) Assignee: Norddeutsche Affinerie Aktiengesellschaft, Hamberg (DE)

( * ) Notice: Subject to any disclaimer, the term of this patent is extended or adjusted under 35 U.S.C. 154(b) by 254 days.

(21) Appl. No.: 10/333,222

(22) PCT Filed: Jun. 21, 2001

(86) PCT No.: PCT/DE01/02316

§ 371 (c)(1),
(2), (4) Date: Jul. 18, 2003

(87) PCT Pub. No.: WO02/08476

PCT Pub. Date: Jan. 31, 2002

(65) Prior Publication Data

US 2004/0007091 A1 Jan. 15, 2004

(30) Foreign Application Priority Data

Jul. 21, 2000 (DE) ..... 100 35 593

(51) Int. Cl.
*C22B 15/14* (2006.01)

(52) U.S. Cl. ..... 266/220; 266/234

(58) Field of Classification Search ..... 266/242, 266/234, 217, 220

See application file for complete search history.

(56) References Cited

U.S. PATENT DOCUMENTS

| | | | | |
|---|---|---|---|---|
| 1,839,927 | A * | 1/1932 | Heinrich | 75/10.16 |
| 2,741,557 | A | 4/1956 | Wolf | |
| 2,821,472 | A | 1/1958 | Peterson et al. | |
| 3,618,917 | A * | 11/1971 | Fredrikson et al. | 266/220 |
| 3,743,500 | A * | 7/1973 | Foulard et al. | 266/220 |
| 4,139,184 | A * | 2/1979 | Griffith et al. | 266/220 |
| 4,265,432 | A * | 5/1981 | Lajovic et al. | 266/220 |
| 5,037,471 | A | 8/1991 | Iwamura et al. | |
| 5,850,034 | A | 12/1998 | Hugens, Jr. | |

FOREIGN PATENT DOCUMENTS

DE DT 928672 6/1955

(Continued)

OTHER PUBLICATIONS

Gunter Paul et al: "Betriebserfahrungen mit Gasspuelsteinen mit gerichteter Porositaet bei den Badischen Stahlwerken AG", *Radex-Rundschau*, pp. 288-302, Dec. 1987.

*Primary Examiner*—Scott Kastler
(74) *Attorney, Agent, or Firm*—Harness, Dickey & Pierce

(57) ABSTRACT

A process and a device serve for decreasing the oxygen content of a copper melt. One or more flushing plugs, from which a scavenging gas emerges, are arranged in the perpendicular direction in the lower region of the copper melt. The scavenging gas ascends into the copper melt, and the copper melt itself is electrically stirred. The copper is initially melted in a shaft furnace, and then it is led to a treatment furnace via a transportation channel. As a result of flowing out of the flushing plugs, the scavenging gas ascends into the copper melt both in the region of the transportation channel and also in the region of the treatment furnace. The scavenging gas flows out of at least one of the flushing plugs with a composition corresponding to 30% to 70% reducing gas and 70% to 30% inert gas.

22 Claims, 2 Drawing Sheets

FOREIGN PATENT DOCUMENTS

| | | | |
|---|---|---|---|
| DE | 235586 | | 10/1965 |
| DE | DT 2019538 | | 11/1971 |
| DE | 2255977 | | 5/1973 |
| DE | DT 2517957 | | 4/1975 |
| DE | 36 40 753 | | 6/1987 |
| DE | 43 35643 | C1 | 10/1994 |
| DE | 198 44 667 | A1 | 3/2000 |
| DE | 0 992 597 | A1 | 4/2000 |
| FR | 1582780 | | 1/1968 |
| GB | 2 220 424 | A | 1/1990 |
| JP | 53-64617 | | 6/1978 |
| WO | WO95/06534 | | 3/1995 |

* cited by examiner

METHOD AND DEVICE FOR REDUCING THE OXYGEN CONTENT OF A COPPER MELT

This application is the national phase under 35 U.S.C. § 371 of PCT International Application No. PCT/DE01/02316 which has an International filing date of Jun. 21, 2001, which designated the United States of America and which claims priority on German Patent Application number DE 100 35 593.5 filed Jul. 21, 2000, the entire contents of which are hereby incorporated herein by reference.

FIELD OF THE INVENTION

The invention generally relates to a method or process for decreasing the oxygen content of a copper melt. Preferably, it relates to one whereby at least one flushing plug is arranged in the lower region of the copper melt, and at least one scavenging gas emerges from the flushing plug and ascends into the copper melt.

The invention also generally relates to a device for decreasing the oxygen content of a copper melt. Preferably, it relates to one whereby the device is essentially constructed in the form of a closed treatment vessel or a closed treatment furnace in which the copper melt can be thermostatically regulated and/or thoroughly mixed by use of an electric current.

BACKGROUND OF THE INVENTION

Many processes are already known for manufacturing copper and its alloys with very low concentrations of impurities, e.g. less than 50 ppm, and/or with very low oxygen contents, e.g. less than 5 ppm. Similar processes are also used in industry for other metals (e.g. in the case of aluminum and iron).

The objective of the various technologies in accordance with the prior art usually involves the following:

the removal of reaction products, and/or impurities, and/or materials comprising slag, and/or the individual/miscellaneous elements that are present in the liquid metal.

The following are known in this regard in order to achieve the desired refining effects: the use of e.g. filters, the provision of dwell times for settling processes, treatment via additions that react with the impurities, the use of physical separating processes such as e.g. scavenging, the application of a vacuum, etc. in one or more steps in combination with the above technologies, or in the form of the pertinent individual application of these technologies.

These processes have become known and have found their widest application in the treatment of aluminum and steel along with their alloys, whereas they are used only in part in the copper industry.

Poling with tree trunks and reducing gases have generally been used from time immemorial for removing the oxygen content of copper during its manufacture. The addition of reducing elements, such as e.g. phosphorus and lithium or boron in the form of e.g. starting alloys, is also known. Use is also made of filters, slag sumps, vacuum chambers/vacuum furnaces and/or settling times in order to purify the metal.

In the case of copper, all the processes that are listed above are applied and exploited in a widespread manner in order to decrease its very high concentrations of impurities and/or oxygen (e.g. in excess of 200-2000 ppm). Likewise, it is known that deoxidizing agents, such as e.g. phosphorus, can also be used simultaneously as an alloying element for achieving particular material properties.

In order to manufacture very pure copper materials, use is made almost generally of electrolytically refined copper (cathodes) as the basic material whose level of impurities in the case of stock market registered versions lies below 100 ppm as a result of the preceding steps in the refining procedure (thermal and chemical).

In the case of the additional thermal processing steps via melting and casting that then always follow on, the concentration of impurities and/or the concentration of oxygen is decreased further as a result of additional process steps and, in part, via the technologies that are listed above, or, as the case may be, the contamination level, which is caused by melting and casting or which is still present, is eliminated.

Thus, for example, electrical melting down of copper cathodes is used in the form of a discontinuous or continuous standard process for decreasing the oxygen content to below 5 to 15 ppm, whereby, in some processes, the cathodes are additionally heated to 950° C. beforehand via gas burners in order to increase melting efficiency or to remove adhering/included impurities.

Melting down then takes place in an electric furnace, which is provided with wood charcoal and/or a reducing protective gas, which is largely free from hydrogen, or, preferably, in induction furnaces. Transfer of the liquid copper then takes place via a channel, which, if necessary, is electrically heated and which is also flooded with a reducing/protective gas, and thence into a holding furnace/buffer furnace/settling furnace that is also usually constructed in the form of an induction furnace, and that is again covered with wood charcoal, and/or that it is flooded with a reducing/protective gas. After leaving this furnace, the melt is transferred via a channel, which is also electrically heated and which is flooded with a reducing/protective gas, and thence into an electrically heated tundish that is also covered with wood charcoal, and/or that is flooded with a reducing/protective gas. On its way from the tundish, the liquid metal arrives, usually via a ceramic valve, which is installed in the bottom, in the ingot mold that is, in part, also covered with a reducing/protective gas and/or with e.g. carbon black, whereby the metal solidifies continuously in the ingot mold and is drawn off continuously or discontinuously.

This standard process that has been described is essentially based on a reducing atmosphere in the furnace and the channels and, in particular, on the large exchange surface between the metal and the reducing/protective gas inside the transfer system in the channels, and also on the long dwell time inside the furnace.

Processes are also known within, and in addition to, this standard process that, in part, conduct the above process steps without, or only in part with, a reducing/protective gas. Processes are also known that merely seek to achieve low oxygen contents via long dwell times of the liquid metal in an induction furnace under a covering of wood charcoal.

Moreover, processes are known that additionally undertake the treatment of the liquid metal via a vacuum and/or, additionally, the above standard process or, as the case may be, their modifications.

It is already known from DE-OS 36 40 753 that a mixture comprising a gaseous hydrocarbon and an inert gas can be blown into a copper melt in order to remove oxygen from the copper melt. This blowing in procedure can take place by using a porous clay brick, or by using a special nozzle.

An additional process and a device are known from DE-OS 20 19 538 for de-gassing and purifying metal melts.

In particular, a procedure is described for decreasing the proportion of oxygen in a copper melt when using porous flushing plugs from which an inert gas emerges that ascends into the copper melt. Reducing or oxidizing gases can be added to the inert gas.

The devices and processes in accordance with the prior art are not suitable to an adequate extent for decreasing the oxygen content of the metal melt to a proportion of less than 5 ppm in a reproducible manner and at an adequate production speed together with appropriate costs for carrying out the process.

SUMMARY OF THE INVENTION

A problem for an embodiment of the present invention is therefore to indicate a process such that, in the case of large scale industrial use, a prescribed oxygen content can be achieved in a reproducible manner and at appropriate and low costs relative to the prior art as sketched above.

In accordance with an embodiment of the invention, this problem may be solved by way of a feature that the copper is initially melted in a gas fired shaft furnace, and then it is led to a treatment furnace via a channel that is also gas fired.

A device in accordance with DE 2 517 957 C2 can be used as the shaft furnace.

In this case, the scavenging gas emerges both in the region of the channel and/or in the region of the treatment furnace as a result of flowing out of the flushing (porous) plugs from below, and thence through the copper melt, whereby the scavenging gas flows out from at least one of the flushing plugs with a composition corresponding to 30% to 70% reducing gas and 70% to 30% inert gas. The shaft furnace is configured in such a way that copper with little oxygen and hydrogen and low concentrations of gas is continuously melted and transferred to the channel.

An additional problem for an embodiment of the present invention is to construct a device of the type that was designated in the introduction such that a decrease in the oxygen content of the copper melt can be implemented in a continuous process and at an appropriate production speed.

This problem may be solved by way of the feature that flushing plugs are arranged in the region of the bottom and the sides as well as in the outlet region of the treatment furnace in such a way that a vertical flow of ascending scavenging gas is formed within the copper melt, whereby, in addition to the treatment furnace, a completely closed system is formed with controlled conditions for the metal and gases.

Basically, the process and the device are suitable for being operated completely continuously. Casting of the copper melt can also be carried out discontinuously, depending on the treatment furnace that is used. In particular, thought has been given to melting down the starting material in a shaft furnace that is gas fired and that is favorable in regard to costs.

As a result of the process in accordance with an embodiment of the invention and the device in accordance with an embodiment of the invention, it is possible to manufacture copper continuously with an oxygen content of less than 5 ppm and with a density that is greater than 8.9. In the event of carrying out the process, both the investment costs for the manufacture of the production plant and the operating costs in DM [German marks]/metric ton are decreased relative to the prior art.

BRIEF DESCRIPTION OF THE DRAWINGS

Examples of embodiments of the invention are illustrated schematically in the drawings. The following aspects are shown.

DETAILED DESCRIPTION OF THE PREFERRED EMBODIMENTS

Figure 1:
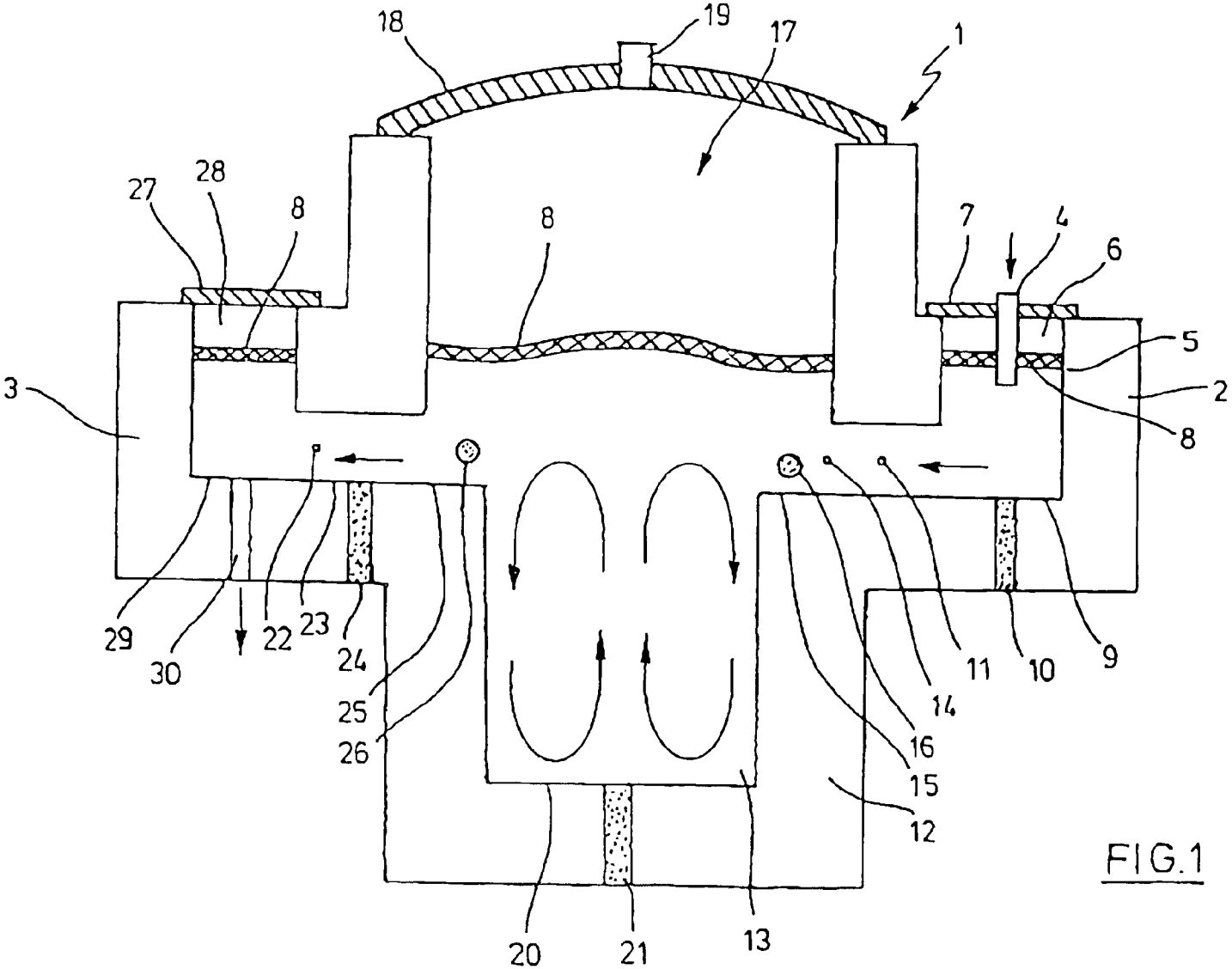
FIG. 1 shows a cross section through a treatment furnace.

It can be seen from the schematic cross section in FIG. 1 that the process technical treatment of the copper melt takes place inside a treatment furnace (1). The treatment furnace (1) is provided with an inlet portion (2) and an outlet portion (3). The copper melt is preferably transferred to the inlet portion (2) from above via a supply port (4).

A level for the height of the melt is provided in such a way inside the inlet portion (2) that a free zone (6) remains in the perpendicular direction above the filling level (5) between the melt and the inlet lid (7). The melt is provided with a cover layer (8) inside the inlet portion (2), whereby this cover layer can be formed from e.g. carbon black or wood charcoal. The supply port (4) extends into the melt in the perpendicular direction so that the supply of melt takes place below the covering layer (8).

In the case of the form of embodiment that is illustrated, one or more inlet [porous] flushing plugs (10) are provided from which the scavenging gas mixture ascends in order to decrease the oxygen content of the melt.

The inlet portion (2) is connected to a connecting channel (11) at the central portion (12) of the treatment furnace (1). The connecting channel (11) extends below the filling level of the melt in the treatment furnace (1). In particular, thought has been given to arranging the connecting channel (11) directly above the inlet bottom (9), and localizing the upper boundary of the connecting channel (11) at a certain distance from the inlet bottom (9) such that the inlet channel (11) is restricted at the top, in a perpendicular direction, to approximately half the filling height of the melt inside the inlet portion (2).

A crucible-like depression or tunnel-like depression (13) is provided in the region of the central portion (12), whereby the melt flows into this depression. In accordance with the form of embodiment in FIG. 1, thought has been given, in particular, to arranging an inlet bottom (15) at a certain height in the region of an inlet (14) of the central portion (12), whereby this height corresponds to approximately the height, or to the lower level, of the inlet bottom (9) of the inlet portion (2). One or more [porous] flushing plugs can be positioned in the region of the inlet bottom (15) or above the inlet bottom (15).

The melt inside the central portion (12) can also be provided with a cover layer (8). A gas collection zone (17) is arranged above the cover layer (8), whereby this zone is restricted in the upward perpendicular direction by a furnace lid (18). The furnace lid (18) has a gas outlet (19).

One or more [porous] flushing plugs (21) are arranged in the region of the bottom (20) of the central portion (12). The [porous] flushing plug(s) (21) is/are preferably placed in such a way that the ascending gas bubbles produce a flow of the melt inside the depression (13) such that the flow direction in the central region points upward in a perpendicular direction, and a flow direction in the perpendicular direction downward is achieved in the edge regions. These flow directions are sufficiently intensely redirected, e.g. by means of electric fields and/or inductors, that the exchange reactions between the [porous] flushing plug and the melt are intensified/prolonged. As a result of this, one ensures that, in the region of the central portion (12), a melt, which is flowing in, is initially guided in the direction of the bottom (20) and that, as a result of this, adequate contact is ensured with the scavenging gas that is emerging from the [porous] flushing plug(s) (21). If required, the flow that is formed can also be assisted by an electrical heating system that has been provided.

The central portion (12) is connected to the outlet portion (3) via an outlet channel (22). The outlet channel (22) has a height localization arrangement that is similar to the connecting channel (11). An upper height restriction of the outlet channel (22) is provided at approximately half the filling height of the melt inside the outlet portion (3). One or more [porous] flushing plug(s) can be arranged in the region of the bottom (23) of the outlet channel (22).

An outlet bottom (25) is provided in the region of a transition from the central portion (12) to the outlet channel (22), whereby this outlet bottom extends to approximately the same height as the channel bottom (23) and the inlet bottom (15). One or more [porous] flushing plug(s) (26) can be placed in the region of the outlet bottom (25) or above the outlet bottom (25).

The melt can also be provided with a cover layer (8) inside the outlet portion (3), and a free zone (28) is provided above the cover layer (8) between the outlet lid (27) and the filling level. A outlet opening (30) for running off the melt is arranged in the region of the outlet bottom (29).

Figure 2:
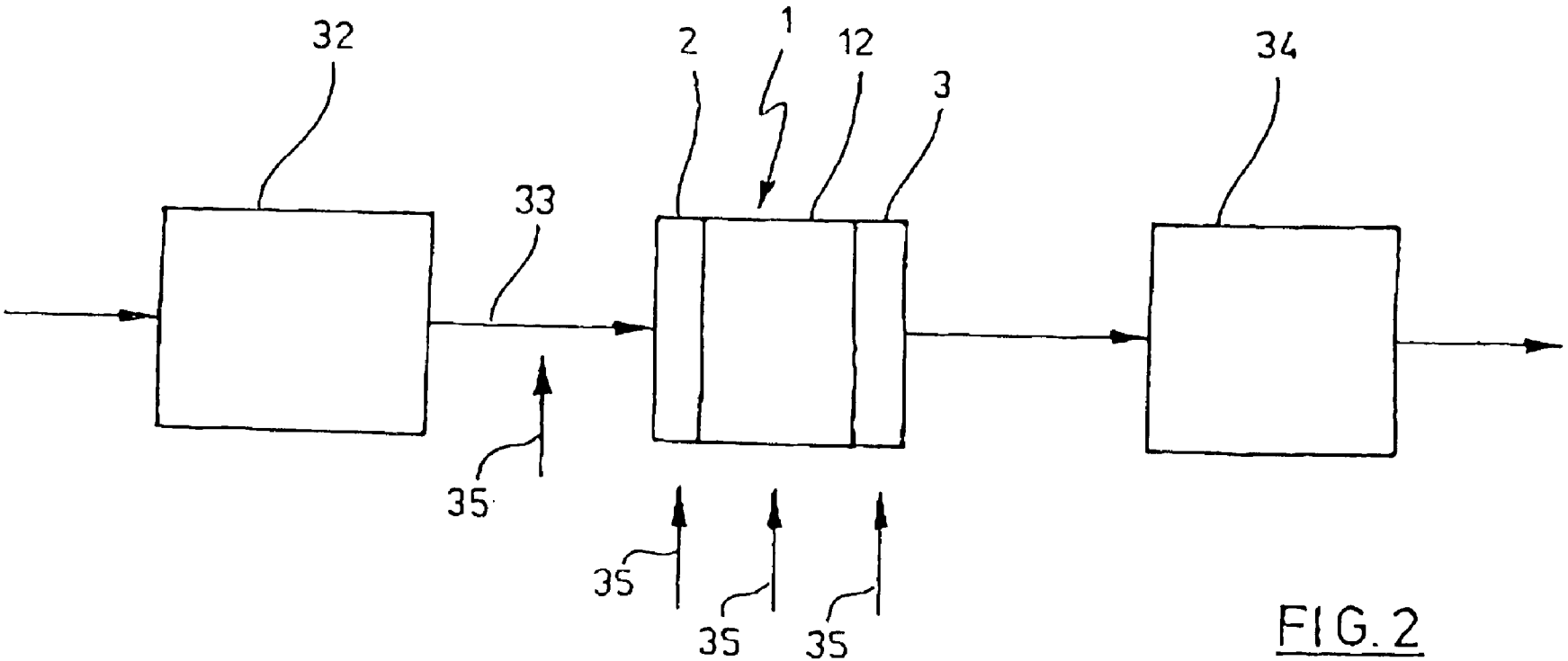
FIG. 2 shows a block circuit diagram in order to illustrate the flow of materials.

In the highly schematic illustration in FIG. 2, the aspect is illustrated that the starting material (31) that is to be melted is initially supplied to a melting furnace (32), and then it is transported via a channel (33) in the region of the treatment furnace (1). Impacting with scavenging gas can take place in the region of the channel (33), and in the region of the inlet portion (2), and in that of the outlet portion (3), and in that of the central portion (12). The respective supply lines (35) for the scavenging gas have been drawn in.

Melting down via gas in the shaft furnace, whose shaft acts like a heat exchanger, is significantly more efficient and thus more economical in terms of energy than melting down by use of an electric current in the induction furnaces of standard processes.

The liquid metal, which has been melted in this way and which has been pre-adjusted (in terms, inter alia, of oxygen, total gas content, and impurities) arrives continuously in the gas fired channel (33) on its way from the sampling hole, whereby this channel is controlled and equipped in a similar manner to that in the cathode shaft furnace.

The copper arrives in the treatment furnace (1) on its way from the gas fired and/or electrically heated and covered and/or closed channel (33), whereby this treatment furnace can simultaneously be a casting furnace.

In addition to the slag sump, further sumps can be arranged within the length of the channel, whereby these additional sumps are heated by inductors, and whereby [porous] flushing plugs are arranged therein in such a way in the bottom and/or from above that intimate mixing of the liquid metal and the scavenging gases takes place in these sumps. These sumps are connected to the channel (33) either in a direct serial manner or via siphon-type skimmers.

The inductors that are designated above can be channel inductors and also crucible inductors. Depending on whether one or several treatment/casting furnaces are being used, the channel (33) can be arranged such that it is either fixed in position or movable.

As in the case of melting down, transfer via gas heating is significantly more efficient and thus more economical in terms of energy than transfer in the case of the fully electrically heated channels (33) of the standard process.

The treatment furnace (1) is preferably a closed, fire resistant, masonry lined vessel. This can be arranged in such a way that it is either fixed in position or movable and, moreover, it can be present either in merely single form or in multiple form depending on the casting technology and/or the performance design.

On its way from the channel (33), the pre-treated liquid copper, which comes into the treatment furnace (1), is admitted—e.g. via a bottom drain under the bath or in the flat supply conduit—to the inlet region (2) of the treatment furnace, whereby this inlet region is covered with reducing agents, e.g. wood charcoal, and it is sealed off from the atmosphere via lids.

The bottom (9), and/or the sides, and/or the lids (7) of the inlet portion (2) are equipped with flushing nozzles in such a way that intimate mixing together is ensured between the copper, which is flowing in, and the scavenging gas. Depending on its holding capacity, the inlet portion (2) can also be provided with inductors as in the case of the channel (33).

On its way from the inlet portion (2), the liquid copper, which has been additionally treated in this way, arrives at the central portion (12) of the treatment furnace (1) either directly or via a siphon-type skimmer. This portion of the furnace is also sealed off from the atmosphere via a lid (18), and the metal strip therein is covered with reducing agents, e.g. carbon black.

The bottom (20), and/or the sides, and/or the entrance and exit regions of the central portion (12) are equipped with flushing nozzles in such a way that intimate mixing together is ensured between the copper, which is flowing in, and the scavenging gas.

In addition, the bottom (20) is provided with one or more inductors and/or an electromagnetic stirrer so that the melt is moved additionally and, as a result of this, intimate mixing together takes place between the scavenging gases and the copper that is flowing in and out in the case of e.g. continuous operation; the wood charcoal cover and, if required, the melt in the treatment furnace (1) are held at the required casting temperature or, as the case may be they are brought to this casting temperature.

On its way from the central portion (12), the melt arrives at the outlet portion (3) either directly or via a siphon-type skimmer, whereby this outlet portion is also covered with reducing agents, e.g. wood charcoal, and is sealed off from the atmosphere with lids (27).

Depending on the construction, [porous] flushing plugs and inductors can also be installed in the outlet section (3) in a similar manner to the inlet portion (2). The melt then arrives in the ingot mold/molds under the bath via a ceramic valve and a ceramic pipe, including a nozzle, under the bath.

Depending on the casting process, the ingot mold can also be directly flange connected to the outlet portion (3) under the bath, so that the above mentioned ceramic valve is then eliminated. If the ingot mold is flange connected above the bath, then an appropriate mechanical or electromagnetic pump can be installed in the form of a closed construction, e.g. between the outlet portion (3) and the ingot mold, or, in the case where the ingot mold is closed, the melt can be drawn into the ingot mold in the form of its solidified billet in accordance with a known process.

The non flange connected ingot mold and the liquid metal in the upper part of the ingot mold are sealed off from the atmosphere by covering with e.g. a protective gas, and/or carbon black, and/or mixtures of carbon black and wood charcoal.

Ingot molds that are flange connected or non flange connected are also sealed off from the atmosphere via a protective gas at their end from which metal emerges. The metal is now solidified but it is still hot.

The protective gas that is used in the channel (33) and in the treatment furnace (1) and for the ingot mold essentially consists of an inert gas, such as e.g. argon, nitrogen, and $CO/CO_2$ mixtures, whereby proportions of inert gas from 100% to 70% in the mixture have proven to be effective depending on the blowing in location, and proportions of $CO/CO_2$ from 0% to 30% in the mixture have proven to be effective depending on the blowing in location in the case of usage in accordance with the process, which has been described, and for the purpose in accordance with an embodiment of the invention.

In general, it is expedient to provide a proportion of reducing gas in the range from 40% to 60% of the total gas volume that comprises the reducing gas and the inert gas. The proportion of reducing gas typically amounts to approximately 50%. All the above designated proportions are proportions by volume.

The proportion of reducing gas in the atmosphere of the furnace ought to lie in the range from 10% to 40%. Typically, this proportion amounts to approximately 20%. The proportion of oxidizing gas components in the atmosphere of the furnace amounts to approximately 0% to 10%. A proportion of 5% is typically present.

The [porous] flushing plugs, their internal configuration, and their arrangement in the fire resistant masonry lining or in the lids and thus the bath height or blowing-in depth, which is located above them, and their positional distribution and their number in the channel (33) and in the treatment furnace (1) are governed by the pertinent parameters that are in place or, as the case may be, the parameters that are to be set up.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A device for decreasing the oxygen content of a copper melt, comprising:

a treatment furnace, the treatment furnace including an inlet portion, a central portion including a recess having a bottom surface surrounded by sidewalls, and an outlet portion;

at least one inductor, for thermostatically regulating a temperature of the copper melt within the recess; and at least one porous plug, arranged in a central region of the bottom surface of the recess, arranged and configured for establishing a recirculating flow within the copper metal contained in the recess, wherein the recirculating flow includes an upward vertical flow in a central portion of the recess and a corresponding downward vertical flow in a peripheral portion of the central region that surrounds the central portion.

2. A device in accordance with claim 1, further comprising:

an inlet porous plug arranged in the region of a transition from the central portion to the inlet portion.

3. A device in accordance with claim 1, further comprising:

an outlet porous plug arranged in the region of a transition from the central portion to the outlet portion.

4. A device in accordance with claim 1, wherein a connecting channel is arranged between the central portion and the inlet portion to transfer the copper melt from the inlet portion to the central portion.

5. A device in accordance with claim 1, wherein an outlet channel is arranged between the central portion and the outlet portion to transfer the copper melt from the central portion to the outlet portion.

6. A device in accordance with claim 1, wherein a gas collection zone is provided in an upper region of the central portion.

7. A device in accordance with claim 1, wherein a free zone is provided in an upper region of the inlet portion.

8. A device in accordance with claim 1, wherein a free zone is provided in an upper region of the outlet portion.

9. A device in accordance with claim 1, wherein at least one porous outlet plug is arranged in an outlet channel region provided between the central portion and the outlet portion.

10. A device in accordance with claim 1, wherein the treatment furnace is provided with at least one magnetic stirrer.

11. A device in accordance with claim 1, wherein at least one porous plug is arranged in the region of a lateral wall of the treatment furnace.

12. A device in accordance with claim 2, wherein at least one outlet porous plug is arranged in the region of a transition from the central portion to the outlet portion.

13. A device in accordance with claim 4, wherein a gas collection zone is provided in an upper region of the central portion.

14. A device in accordance with claim 4, wherein a free zone is provided in an upper region of the inlet portion.

15. A device in accordance with claim 4, wherein a free zone is provided in an upper region of the outlet portion.

16. A device in accordance with claim 5, wherein a gas collection zone is provided in an upper region of the central portion.

17. A device in accordance with claim 5, wherein a free zone is provided in an upper region of the inlet portion.

18. A device in accordance with claim 5, wherein a free zone is provided in an upper region of the outlet portion.

19. A treatment furnace for decreasing the oxygen content of a copper melt, comprising:

an inlet through which the copper melt is introduced into the treatment furnace;

a central portion connected to the inlet to receive the copper melt from the inlet, the central portion having a recessed region with a lower surface and sidewalls;

an outlet connected to the central portion to receive the copper melt from the central portion; and an inductor forming a minor portion of the lower surface to introduce heat energy into the copper metal contained in the central portion for establishing a circulating recirculating flow within the central portion including an upward central flow and a downward peripheral flow; and a buffer surface surrounding the inductor and forming a major portion of the lower surface between the inductor and the sidewall.

20. The treatment furnace for decreasing the oxygen content of a copper melt according to claim 19, wherein the means for establishing the recirculating flow further comprises:

a porous plug forming a second minor central portion of the lower surface, the porous plug arranged and configured for injecting a scavenging gas into the central portion, wherein the porous plug is surrounded by the buffer surface.

21. A treatment furnace for decreasing the oxygen content of a copper melt, comprising:

an inlet through which the copper melt is introduced into a central portion;

an outlet connected to the central portion to receive the copper melt from the central portion wherein the inlet and outlet are arranged in a horizontal plane;

a recessed region provided in the central portion and extending below the horizontal plane for holding a volume of the copper melt, the recessed region having a lower surface bounded by a sidewall surface;

a porous plug provided in a first minor central portion of the lower surface arranged and configured for injecting a scavenging gas into the copper melt, thereby inducing a convective upward flow in a central portion of the copper melt and producing a corresponding convective downward flow in peripheral portions of the copper melt within the recess, the upward flow and downward flow cooperating to produce a recirculating convective flow in the copper melt within the recess.

22. The treatment furnace for decreasing the oxygen content of a copper melt according to claim 21, further comprising:

an inductor adjacent a second central portion of the lower surface arranged and configured to heat a central portion of the copper melt within the recess, thereby inducing a convective upward flow in a central portion of the copper melt and producing a corresponding convective downward flow in peripheral portions of the copper melt within the recess, the upward flow and downward flow producing a recirculating convective flow in the copper melt within the recess.

* * * * *